US007731486B2

(12) United States Patent
Yokoyama

(10) Patent No.: US 7,731,486 B2
(45) Date of Patent: Jun. 8, 2010

(54) COMPRESSOR WITH DUAL PATHWAYS FOR RETURNING LUBRICATING OIL

(75) Inventor: Hiroyuki Yokoyama, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 0 days.

(21) Appl. No.: 12/160,201

(22) PCT Filed: Dec. 27, 2006

(86) PCT No.: PCT/JP2006/326009

§ 371 (c)(1),
(2), (4) Date: Jul. 7, 2008

(87) PCT Pub. No.: WO2007/077856

PCT Pub. Date: Jul. 12, 2007

(65) Prior Publication Data

US 2009/0000872 A1 Jan. 1, 2009

(30) Foreign Application Priority Data

Jan. 5, 2006 (JP) ..... 2006-000567

(51) Int. Cl.
*F03C 2/00* (2006.01)
*F04C 18/00* (2006.01)

(52) U.S. Cl. ..... 418/55.6; 418/55.1; 418/97; 418/270; 418/DIG. 1; 55/394; 55/396; 55/423

(58) Field of Classification Search ..... 418/55.1–55.6, 418/57, 270, DIG. 1, 94, 97; 184/6.16–6.18; 55/394, 396, 423, 467, 459.1
See application file for complete search history.

(56) References Cited

U.S. PATENT DOCUMENTS

| | | | | |
|---|---|---|---|---|
| 3,676,024 | A * | 7/1972 | Akaiki | 55/467 |
| 4,470,778 | A * | 9/1984 | Mabe | 418/55.6 |
| 6,152,713 | A * | 11/2000 | Hisanaga et al. | 418/55.6 |
| 6,227,831 | B1 * | 5/2001 | Osima et al. | 418/55.6 |
| 2005/0226756 | A1 * | 10/2005 | Ito | 418/55.6 |

FOREIGN PATENT DOCUMENTS

| | | | | |
|---|---|---|---|---|
| JP | 62126282 | A * | 6/1987 | 418/55.6 |
| JP | H11-082352 | A | 3/1999 | |

* cited by examiner

*Primary Examiner*—Theresa Trieu
(74) *Attorney, Agent, or Firm*—Baker Botts, LLP.

(57) ABSTRACT

This invention provides a compressor that can efficiently return lubricating oil through an oil storage chamber to a lubrication target site without residence of the lubricating oil within the discharge chamber and can prevent deterioration in lubrication performance. The compressor comprises a housing having a discharge chamber for lubricating oil-containing hydraulic fluid and a discharge port communicating with the discharge chamber, a rotational shaft extended into the housing, a compression unit for the suction, compression and discharge of the hydraulic fluid through the drive of the rotational shaft, and a lubricating oil separator comprising a separation chamber and an oil storage chamber. The separation chamber is provided between the discharge chamber and the discharge port in the housing. The oil storage chamber is located below the separation chamber. Lubricating oil separated from the hydraulic fluid in the separation chamber is introduced through an oil hole is stored in the oil storage chamber. The compressor further comprises a communication section for directly communicating the discharge chamber and the oil storage chamber without through the separation chamber.

9 Claims, 3 Drawing Sheets

COMPRESSOR WITH DUAL PATHWAYS FOR RETURNING LUBRICATING OIL

Cross-Reference To Related Applications

This application is the National Stage of International Patent Application No. PCT/JP2006/326009, filed Dec. 27, 2006, which claims the benefit of Japanese Patent Application No. 2006-000567, filed Jan. 5, 2006, the disclosures of which are incorporated herein by reference in their entirety.

TECHNICAL FIELD OF THE INVENTION

The present invention relates to a compressor, and specifically, to a compressor suitable for use in a refrigeration circuit of an air conditioning system for vehicles, etc.

BACKGROUND ART OF THE INVENTION

A compressor for a refrigeration circuit compresses refrigerant, and usually lubricating oil is contained in the refrigerant. The lubricating oil contained in the refrigerant has not only a function for lubricating slidable surfaces, bearings, etc. in the compressor but also a function for sealing the slidable surfaces. However, if the lubricating oil is circulated over the entire refrigeration circuit, generally the lubricating oil becomes a factor decreasing the cooling ability of the refrigeration circuit.

Therefore, a compressor incorporating a lubricating oil separator thereinto is known. The lubricating oil separator separates lubricating oil from compressed refrigerant on the route through which the refrigerant compressed in the compressor is introduced from a discharge chamber to a discharge port. More concretely, the lubricating oil separator has a separation chamber disposed between the discharge chamber and the discharge port, and it separates the lubricating oil from the compressed refrigerant which is introduced from the discharge chamber into the separation chamber through a spouting hole. The lubricating oil separated from the refrigerant is stored in an oil storage chamber formed below the separation chamber (for example, Patent document 1).

Patent document 1: JP-A-11-82352

DISCLOSURE OF THE INVENTION

Problems to be Solved by the Invention

In the above-described conventional structure for the compressor, usually, the spouting hole for introducing the lubricating oil from the discharge chamber into the separation chamber is disposed at an upper position of the discharge chamber. Namely, the lubricating oil discharged from the compression mechanism into the discharge chamber together with the compressed refrigerant is liable to stay in the discharge chamber particularly when the flow rate of the compressed refrigerant is small. Since this resident lubricating oil does not contribute to the lubrication at all, it may cause a problem on lubrication performance for maintaining the durability of the compressor properly, but a particular device is not considered for this point in the above-described conventional structure.

Accordingly, an object of the present invention is to provide a compressor which can properly prevent deterioration in lubrication performance by suppressing or preventing undesirable residence of lubricating oil in a discharge chamber.

Means for Solving the Problems

To achieve the above-described object, a compressor according to the present invention comprises a housing having a discharge chamber for lubricating oil-containing hydraulic fluid and a discharge port communicating with the discharge chamber and opened toward outside; a rotational shaft extended into the housing and supported free to rotate via bearings relative to the housing; a compression unit provided in the housing for carrying out the suction, compression and discharge of the hydraulic fluid through the drive of the rotational shaft; a lubricating oil separator provided in the housing, and comprising a separation chamber provided between the discharge chamber and the discharge port, and an oil storage chamber located below the separation chamber, introduced with lubricating oil separated from the hydraulic fluid in the separation chamber through an oil hole and storing the introduced lubricating oil therein; and a communication section for directly communicating the discharge chamber and the oil storage chamber without through the separation chamber.

Namely, as the route from the discharge chamber to the oil storage chamber, there exist two routes of a route from discharge chamber to the oil storage chamber through the separation chamber and the oil hole and a route from discharge chamber directly to the oil storage chamber. By the presence of the latter route, even if the lubricating oil is liable to stay in the discharge chamber, the lubricating oil is to be sent to the oil storage chamber through the above-described communication section, and undesirable residence of lubricating oil in the discharge chamber may be suppressed or prevented. Therefore, by returning the lubricating oil stored in the oil storage chamber to a lubrication target site again, substantially the whole amount of the used lubricating oil may be used for lubrication, and a proper lubrication state may be easily maintained.

The above-described communication section may be formed at the compression unit side, and may be formed at the housing side. Further, the communication section may be formed in both the compression unit and the housing. For example, it is possible to join a communication section formed at the compression unit side and a communication section formed at the housing side to form them as a single communication section.

Further, a structure may also be employed wherein an opening/closing mechanism opened when there is not a pressure difference between the discharge chamber and the oil storage chamber is provided to the above-described communication section.

Although the above-described compression unit is not particularly restricted, for example, it may be formed as a scroll unit comprising a fixed scroll and a movable scroll. In this case, for example, the above-described communication section may be formed in the fixed scroll. Of course, as described above, the communication section may be formed at the housing side, and may be formed in both the fixed scroll and the housing.

The lubricating oil stored in the oil storage chamber may be returned, for example, to suction chamber side, through an appropriate path. By this, the stored lubricating oil can be served again to lubrication for a lubrication target site.

Such a structure of the compressor according to the present invention is suitable particularly for a compressor incorporated into an air conditioning system for vehicles.

Effect According to the Invention

Thus, in the compressor according to the present invention, the discharge chamber and the oil storage chamber are communicated without through the separation chamber, and they are communicated through the communication section separately from the separation chamber. In other words, the discharge chamber and the oil storage chamber are communicated through the separation chamber and the oil hole as well as through the communication section. Therefore, even if there exists lubricating oil liable to stay in the discharge chamber, the lubricating oil is introduced directly into the oil storage chamber without residence. As a result, the lubricating oil discharged from the discharge chamber does not stay in the discharge chamber even under any condition, and it reaches the oil storage chamber and can be served to lubrication. Since the used lubricating oil is effectively utilized for lubrication without causing useless residence, the lubrication performance for slidable surfaces, bearings, etc. in the compressor can be maintained at a good condition, and the durability of the compressor can be improved. Further, As the result of the good lubrication for the compressor, the functions required for the compressor can also be well maintained, and the desirable cooling ability can also be maintained.

Further, if the opening/closing mechanism opened when there is not a pressure difference between the discharge chamber and the oil storage chamber is provided to the communication section, even under a condition where the lubricating oil discharged from the compression unit is liable to stay, it is avoided that the lubricating oil is continuing to stay in the discharge chamber, and the lubricating oil is well collected into the oil storage chamber.

EXPLANATION OF SYMBOLS

Figure 1:
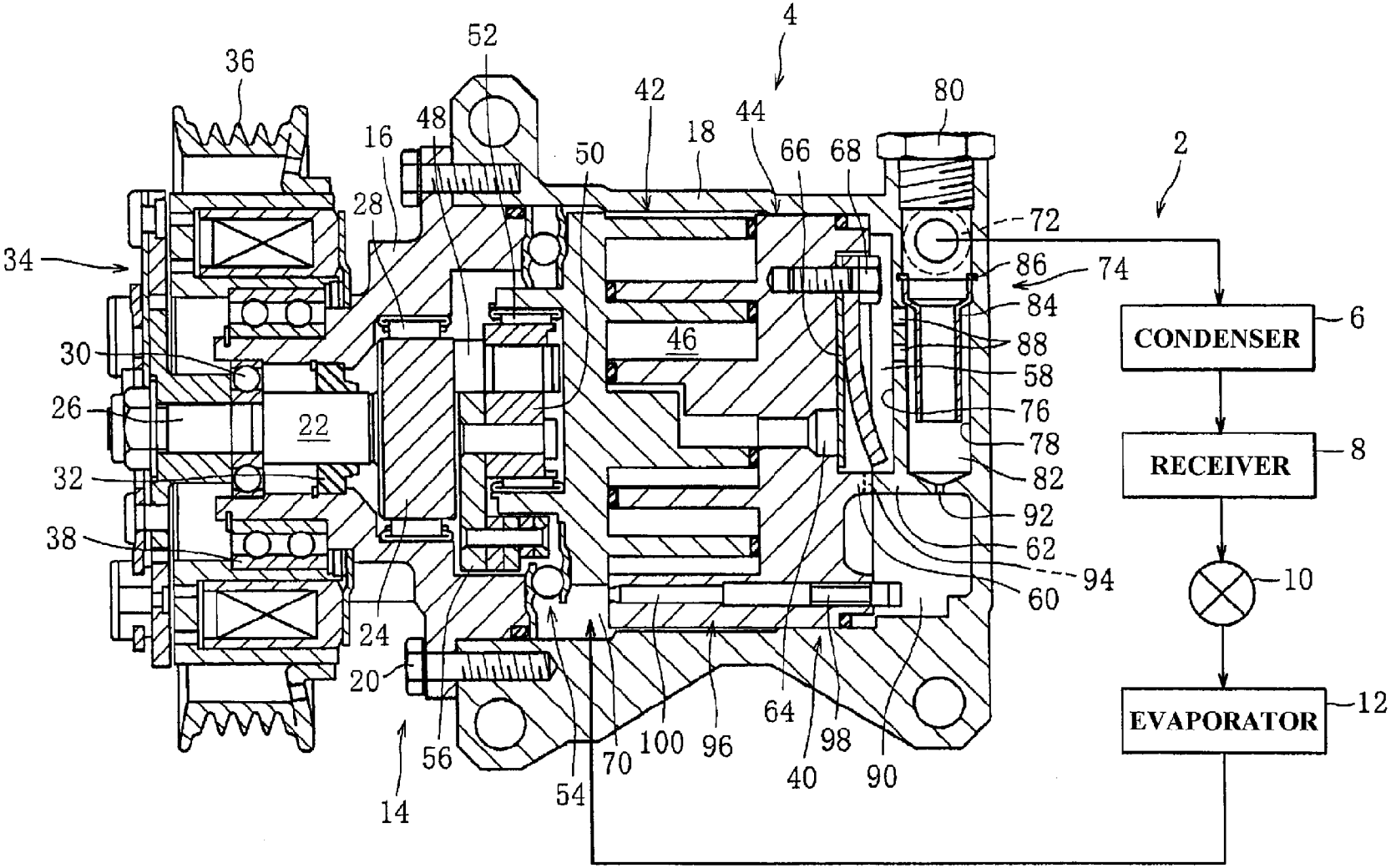
FIG. 1 is a vertical sectional view of a compressor according to an embodiment of the present invention.

4: compressor (scroll type compressor)
18: casing (compression housing)
22: rotational shaft
40: compression unit (scroll unit)
44: fixed scroll
58: discharge chamber
60: partition wall
72: discharge port
74: lubricating oil separator
82: separation chamber
90: oil storage chamber
92: oil hole
94: communication section (slit)

The Best Mode for Carrying Out the Invention

Hereinafter, embodiments of the present invention will be explained referring to figures.

FIG. 1 depicts a compressor according to an embodiment of the present invention. This compressor is formed as a scroll type compressor 4, and it is incorporated into a refrigeration circuit 2 of an air conditioning system for vehicles. Concretely, in the circulation route of refrigeration circuit 2, compressor 4, a condenser 6, a receiver 8, an expansion valve 10 and an evaporator 12 are disposed in order, and the compressor 4 sucks refrigerant from the backward path of the circulation route, compresses the refrigerant and discharges the refrigerant toward the outward path of the circulation route. The refrigerant contains lubricating oil, and the lubricating oil lubricates bearings and various slidable surfaces in compressor 4 as well as exhibits a function for sealing the slidable surfaces.

The above-described compressor 4 has a housing 14. This housing 14 is formed from a drive casing 16 and a compression casing 18, and these casings 16 and 18 are connected by flanges to each other via fastening bolts 20. A rotational shaft 22 is disposed in drive casing 16, and rotational shaft 22 has a larger-diameter end part 24 located at compression casing 18 side and a smaller-diameter shaft part 26 projected from drive casing 16 via a lip seal 32. Larger-diameter end part 24 is supported free to rotate in drive casing 16 via a needle bearing 28, and smaller-diameter shaft part 26 is supported free to rotate in drive casing 16 via a ball bearing 30.

A drive pulley 36 incorporated with an electromagnetic clutch 34 is attached to the projected end of smaller-diameter shaft part 26, and drive pulley 36 is supported free to rotate on drive casing 16 via a bearing 38. A power from a drive source (for example, an engine of a vehicle) is transmitted to drive pulley 36 via a drive belt which is not depicted, and the rotation of drive pulley 36 can be transmitted to rotational shaft 22 via electromagnetic clutch 34. Therefore, if electromagnetic clutch 34 is turned on during the drive of the engine, rotational shaft 22 is rotated integrally with drive pulley 36.

On the other hand, compression casing 18 is formed in a cup-like shape having a bottom portion, and a scroll unit 40 as the compression unit is contained in compression casing 18. Scroll unit 40 is formed from a movable scroll 42 and a fixed scroll 44 engaging with each other. The engagement of these scrolls 42 and 44 forms an compression chamber 46 therein, and the capacity of this compression chamber 46 is decreased/increased accompanying with the orbital movement of movable scroll 42 relative to fixed scroll 44.

In order to provide an orbital movement to the above-described movable scroll 42, movable scroll 42 and larger-diameter end part 24 are connected to each other via a crank pin 48, an eccentric bush 50 and a needle bearing 52. Further, The rotation of movable scroll 42 is prevented by a ball-type orbital thrust bearing 54 interposed between movable scroll 42 and drive casing 16. Where, in FIG. 1, symbol 56 indicates a counter weight, and this counter weight 56 is attached to eccentric bush 50.

Fixed scroll 44 is fixed in compression casing 18 via a plurality of fastening bolts which are not depicted, and a discharge chamber 58 is formed between fixed scroll 44 and the bottom portion of compression casing 18. In more detail, the space at the back surface side of fixed scroll 44 is partitioned vertically by a rib-like partition wall 60, and a rib-like partition wall 62 is projected toward fixed scroll 44 on the bottom portion of compression casing 18. These partition walls are abutted to each other, thereby forming discharge chamber and an oil storage chamber 90, respectively.

Fixed scroll 44 has a discharge hole 64 communicating compression chamber 46 and discharge chamber 58 with each other. The refrigerant compressed in compression chamber 46 is discharged into discharge chamber 58 through discharge hole 64, and discharge hole 64 is opened/closed by a discharge valve 66. Discharge valve 66 is attached to fixed scroll 44 via a bolt 68 together with a stopper plate.

On the other hand, a suction chamber 70 is formed between the circumferential wall of compression casing 18 and scroll unit 40, and the suction chamber 70 is connected to the above-described backward path of the circulation route. Further, a discharge port 72 is formed on the outer surface of compression casing 18, concretely, above the bottom portion thereof, and this discharge port 72 is connected to the outward path of the circulation route and is connected also to discharge chamber 58 through a lubricating oil separator 74.

In more detail, lubricating oil separator 74 is disposed in compression casing 18 at a position between discharge chamber 58 and discharge port 72. As shown in the figure, the bottom portion of compression casing 18 has a projected portion 76 formed integrally therewith. This projected portion 76 is formed as a columnar shape projecting toward the inside of discharge chamber 58, and it extends upward from partition wall 62 up to reach the circumferential wall of compression casing 18. A hole 78 is defined in projected portion 76, and the opening end of hole 78 is closed by a plug 80.

Further, the lower portion of hole 78 is formed as a separation chamber 82, and a separation tube 84 is disposed at the upper portion of this separation chamber 82. Separation tube 84 has a larger-diameter part at its upper end, and this larger-diameter part is press-fitted into hole 78 and fixed in hole 78, that is, in separation chamber 82. Moreover, a snap ring 86 is disposed at the upper end of separation tube 84, and snap ring 86 prevents getting out of separation tube 84 from separation chamber 82. An annular space is formed between the inner circumferential surface of separation chamber 82 and the outer circumferential surface of the smaller-diameter part of separation tube 84, and two refrigerant spouting holes 88 are formed at upper and lower positions in projected portion 76 for communicating discharge chamber 58 and this annular space. These refrigerant spouting holes 88 are formed so that their axial lines are along the outer circumferential surface of the smaller-diameter part of separation tube 84.

Oil storage chamber 90 formed below partition wall 62 is communicated with separation chamber 82 through an oil hole 92 formed on partition wall 62. A return path 96 for returning lubricating oil is ensured in fixed scroll 44 for communicating oil storage chamber 90 and suction chamber 70, and an orifice 100 having a filter 98 is interposed in this return path 96.

Figure 2:
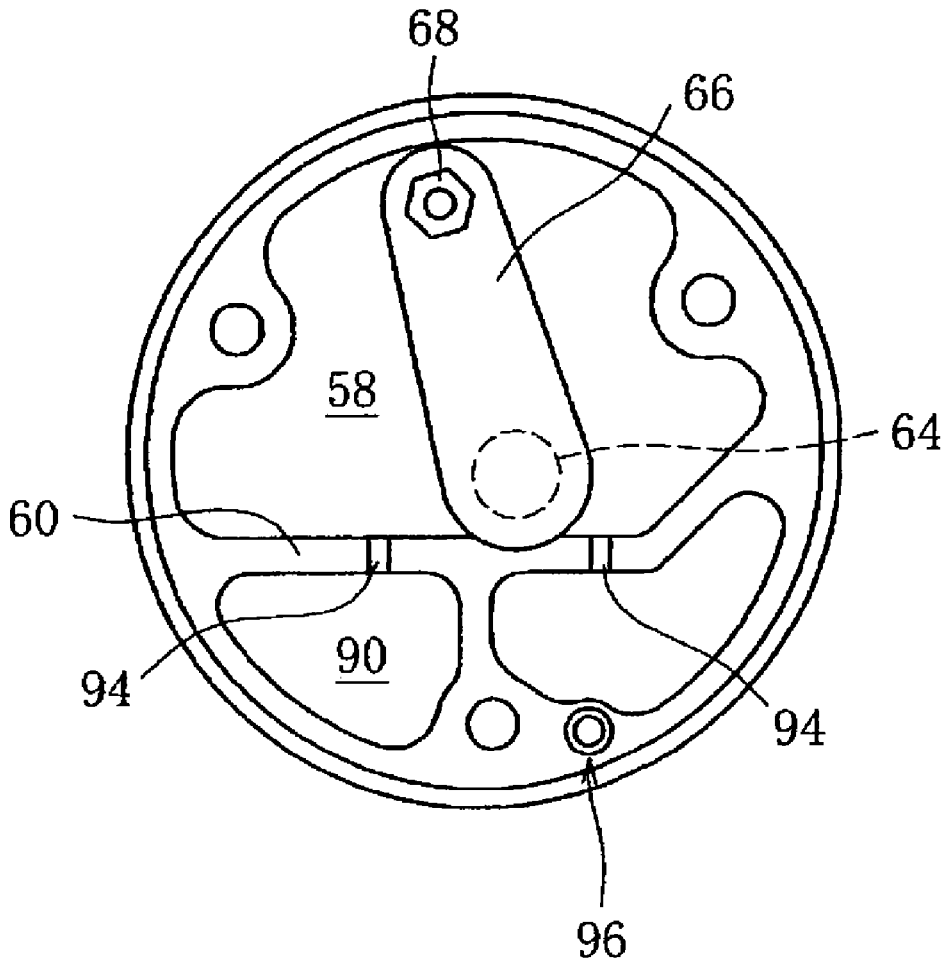
FIG. 2 is a back surface view of a fixed scroll in the compressor depicted in FIG. 1.

In this embodiment, the communication section according to the present invention is formed by a slit 94 communicating discharge chamber 58 and oil storage chamber 90. More concretely, as depicted in FIG. 2, two slits 94, 94 are formed on partition wall 60 formed at the back surface side of fixed scroll 44, and these slits 94 directly communicate discharge chamber 58 and oil storage chamber 90 without through separation chamber 82. These slits 94 are disposed, respectively, at appropriate positions extending over discharge hole 64.

In the above-described compressor 4, accompanying with the rotation of rotational shaft 22, movable scroll 42 performs an orbital movement without rotation. This orbital movement of movable scroll 42 causes a suction step of refrigerant from suction chamber 70 into compression chamber 46 and a compression step and a discharge step of sucked refrigerant, and as a result, high-pressure refrigerant is discharged from compression chamber 46 into discharge chamber 58 via discharge valve 66. Here, since lubricating oil is contained in the refrigerant, the lubricating oil lubricates needle bearings 28, 52 in drive casing 16, the slidable surfaces in scroll unit 40, etc. and also contributes for sealing compression chamber 46.

The compressed refrigerant in discharge chamber 58 flows into separation chamber 82 through refrigerant spouting hole 88, and flows down along the outer circumferential surface of separation tube 84 while revolving. In this step, the compressed refrigerant reaches discharge port 72 by flowing up through the inside of separation tube 84, and it is sent from this discharge port 72 toward condenser 6. On the other hand, the lubricating oil in the compressed refrigerant is separated from the refrigerant by centrifugal separation, and it flows down along the inner circumferential surface of separation tube 82. The separated lubricating oil is introduced into oil storage chamber 90 through oil hole 92 and stored therein.

Where, when the flow rate or the flow speed of the refrigerant discharged into discharge chamber 58 is small, although the lubricating oil is liable to stay at the vicinity of partition wall 60 in discharge chamber 58, the lubricating oil is introduced directly into oil storage chamber 90 through the communication section comprising slit 94 and stored therein.

Because oil storage chamber 90 is always in a condition communicating with separation chamber 82, the inner pressure of oil storage chamber 90 is higher than that of suction chamber 70. Therefore, the lubricating oil in oil storage chamber 90 is returned toward suction chamber 70 through orifice 100 based on the pressure difference between oil storage chamber 90 and suction chamber 70. When the lubricating oil is returned from orifice 100 into suction chamber 70, the lubricating oil is atomized and mixed into refrigerant present in suction chamber 70.

Thus, in this embodiment, discharge chamber 58 and oil storage chamber 90 are connected via the communication section comprising slit 94 independently of separation chamber 82. In other words, discharge chamber 58 and oil storage chamber 90 are communicated through the communication section comprising slit 94 as well as communicated through separation chamber 82 and oil hole 92, and it is possible that the lubricating oil is introduced from discharge chamber 58 into oil storage chamber 90 through both routes of the route having separation chamber 82 and oil hole 92 and the route without through separation chamber 82. Therefore, because the lubricating oil in discharge chamber 58 discharged from scroll unit 40 reaches oil storage chamber 90 without staying in discharge chamber 58 at any operational condition, substantially the whole of the amount of the lubricating oil having been contained in the discharged refrigerant contributes to lubrication. In more detail, when the flow rate or the flow speed of the compressed refrigerant is great, most lubricating oil is introduced into separation chamber 82 through spouting hole 88 together with this refrigerant and it is separated from the refrigerant and reaches oil storage chamber 90. On the other hand, when the flow rate or the flow speed of the compressed refrigerant is small, although the lubricating oil is liable to stay in discharge chamber 58 more or less, the lubricating oil, which has been liable to stay, directly reaches oil storage chamber 90 through the communication section comprising slit 94. The lubricating oil stored in oil storage chamber 90 is properly returned into suction chamber 70 through orifice 100.

Consequently, the lubrication performance for needle bearings 28, 52 in drive casing 16 and the slidable surfaces in scroll unit 40 may be ensured, the durability of the compressor may be improved, and the temperature of the sucked refrigerant from suction chamber 70 toward compression chamber 46 may be maintained at a proper value. Moreover, the resistance against the opening operation of discharge valve 66 may be decreased, the pressure loss on the way from compression chamber 46 to discharge chamber 58 may be decreased, and the cooling ability may also be maintained. Furthermore, breakage of discharge valve 58 may also be prevented.

Although one embodiment of the present invention has been explained, it can be variously modified as long as within the scope of the present invention. For example, the communication section in the present invention may be provided to partition wall 62 in compression casing 18 instead of partition wall 60 of fixed scroll 44, or may be provided to both partitions 60 and 62. Further, the communication section may be formed from a groove or a hole other than the above-described slit. Furthermore, the number or the shape thereof is not limited to the above-described embodiment.

Figure 3:
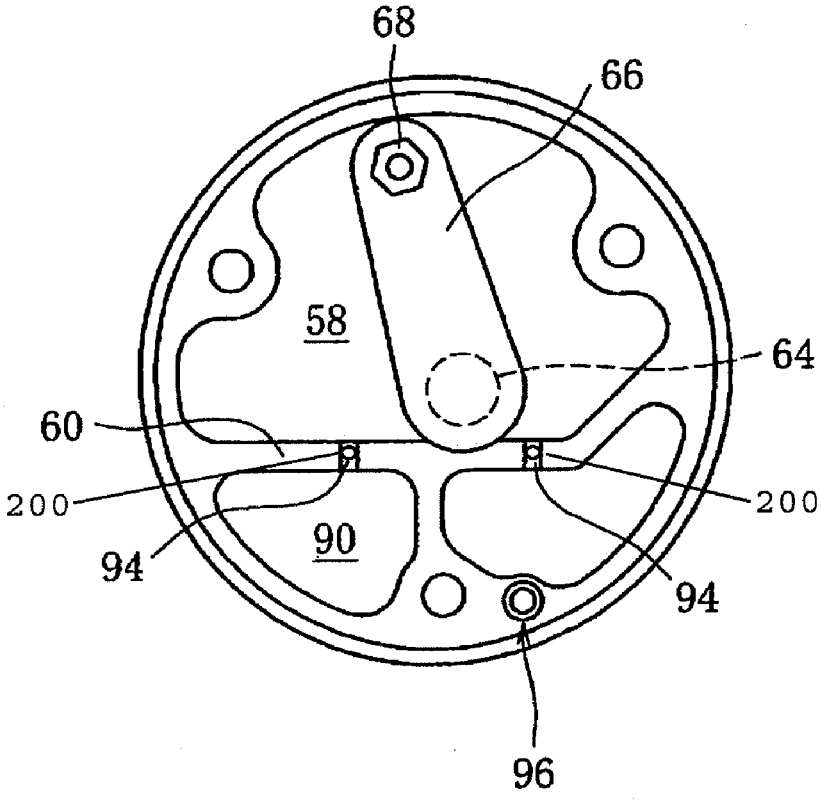
FIG. 3 is a back surface diagram of a fixed scroll, depicting opening/closing mechanisms, in a further embodiment of the invention.

Further, referring to FIG. 3, to the communication section in the present invention, an opening/closing mechanism 200 may be provided. In the structure providing such an opening/closing mechanism, by opening the communication section by the opening/closing mechanism 200 when there is not a pressure difference between discharge chamber 58 and oil storage chamber 90, even in a condition where the lubricating oil discharged from scroll unit 40 is liable to stay in discharge chamber 58, the continuation of the oil staying in discharge chamber 58 may be avoided, and a good lubrication performance may be maintained more surely. As the opening/closing mechanism 200, a mechanism such as a lead valve other than a valve urged by a spring can be employed.

Further, the compression unit in the present invention is not particularly limited, and for example, for any type of the above-described scroll type or a piston reciprocating type, the present invention can be applied. Further, although the above-described embodiment is shown as an example in which the compressor according to the present invention is applied to an air conditioning system for vehicles, the compressor according to the present invention may be applied to any cooling system or refrigeration system.

INDUSTRIAL APPLICATIONS OF THE INVENTION

The present invention can be applied to any compressor as long as it is a compressor for compressing hydraulic fluid containing lubricating oil, and in particular, suitable for a compressor used in a refrigeration circuit of an air conditioning system for vehicles.

The invention claimed is:

1. A compressor comprising:

a housing having a discharge chamber for lubricating oil-containing hydraulic fluid and a discharge port communicating with said discharge chamber and opened toward outside;

a rotational shaft extended into said housing and supported free to rotate via bearings relative to said housing;

a compression unit provided in said housing for carrying out the suction, compression and discharge of said hydraulic fluid through the drive of said rotational shaft;

a lubricating oil separator provided in said housing and comprising a separation chamber provided between said discharge chamber and said discharge port;

an oil storage chamber located below said separation chamber, introduced with lubricating oil separated from said hydraulic fluid in said separation chamber through an oil hole and storing the introduced lubricating oil therein; and a communication section configured to communicate directly said discharge chamber and said oil storage chamber without communicating through said separation chamber.

2. The compressor according to claim 1, wherein said communication section is formed in said compression unit.

3. The compressor according to claim 1, wherein said communication section is formed in said housing.

4. The compressor according to claim 1, wherein said communication section is formed in said compression unit and said housing.

5. The compressor according to claim 1, wherein an opening/closing mechanism opened when there is not a pressure difference between said discharge chamber and said oil storage chamber is provided to said communication section.

6. The compressor according to claim 1, wherein said compression unit is formed as a scroll unit comprising a fixed scroll and a movable scroll.

7. The compressor according to claim 6, wherein said communication section is formed in said fixed scroll.

8. The compressor according to claim 1, wherein said compressor further comprises a path for returning lubricating oil stored in said oil storage chamber to suction chamber side.

9. The compressor according to claim 1, wherein said compressor is a compressor incorporated into an air conditioning system for vehicles.

* * * * *